US007658308B2

(12) United States Patent
Hori et al.

(10) Patent No.: US 7,658,308 B2
(45) Date of Patent: Feb. 9, 2010

(54) SHEET STITCHING APPARATUS

(75) Inventors: Takakazu Hori, Shiga (JP); Masayuki Kashiba, Shiga (JP)

(73) Assignee: Horizon International Inc., Shiga (JP)

( * ) Notice: Subject to any disclaimer, the term of this patent is extended or adjusted under 35 U.S.C. 154(b) by 113 days.

(21) Appl. No.: 12/080,244

(22) Filed: Apr. 1, 2008

(65) Prior Publication Data

US 2008/0245838 A1 Oct. 9, 2008

(30) Foreign Application Priority Data

Apr. 4, 2007 (JP) ..... 2007-098060

(51) Int. Cl.
*B27F 7/21* (2006.01)

(52) U.S. Cl. ..... 227/85; 227/2; 227/82; 227/86

(58) Field of Classification Search ..... 227/2, 227/85, 86, 82
See application file for complete search history.

(56) References Cited

U.S. PATENT DOCUMENTS 4,485,955 A * 12/1984 Hagemann ..... 227/89
4,505,415 A * 3/1985 Gruen ..... 227/88
4,722,467 A * 2/1988 Kunka et al. ..... 227/82
5,518,228 A * 5/1996 Bodie et al. ..... 270/58.11
5,788,139 A * 8/1998 Sikora ..... 227/82
5,921,455 A * 7/1999 Dickhoff ..... 227/86
7,121,540 B2 * 10/2006 Machon et al. ..... 270/52.18
7,537,144 B1 * 5/2009 Marcinik et al. ..... 227/1
2002/0043755 A1 * 4/2002 Machon et al. ..... 270/58.09

* cited by examiner

*Primary Examiner*—Brian D Nash
(74) *Attorney, Agent, or Firm*—Kirschstein, et al.

(57) ABSTRACT

In a sheet stitching apparatus in which a wire W reeled out from a wire reel 5 is cut only a predetermined length, the cut wire is bent into a U-shape and driven into a set of sheets S, both ends of the U-shaped wire are bent and the set of sheets are stitched, there is provided a detector 10-15 arranged for movement according to a change in a degree of bending of the wire guide 4 effected by a change in a remaining amount of the wire of the wire reel 5 for detection of a change of position of the wire guide effected by a pull-in operation of wire by the stitching head 2.

2 Claims, 5 Drawing Sheets

SHEET STITCHING APPARATUS

BACKGROUND OF THE INVENTION

1. Field of the Invention

The present invention relates to a sheet stitching apparatus which cuts a wire reeled out from a wire reel only a predetermined length, bends the cut wire into a U-shape, drives the wire into a set of sheets, bends both ends of the U-shaped wire so as to stitch the set of sheets, and more particularly, to detection of abnormal motion of the sheet stitching apparatus.

2. Description of the Related Art

The sheet stitching apparatus is arranged in a saddle stitch book-binding apparatus used in conjunction with a sheet collator. FIG. 5 is a schematic diagram of such a saddle stitch book-binding apparatus. In FIG. 5, a reference number 31 represents the sheet collator, a reference number 32 represents a stitching head of the sheet stitching apparatus, a reference number 33 represents a clincher of the sheet stitching apparatus, a reference number 34 represents a wire reel, a reference number 35 represents a plate spring type wire guide, a reference number 36 represents a folding knife of a sheet folder, a reference number 37 represents a folding roller of the sheet folder, a reference number 38 represents a cutter of a guillotine cutter, a reference number 39 represents a delivery roller, and reference numbers 40*a* and 40*b* represent discharge trays.

A set of sheets collated by the sheet collator 31 is supplied to the sheet stitching apparatus. The set of sheets is positioned at a stitching position, and a center line of the set of sheets is aligned with the stitching head 32 and the clincher 33. The stitching head 32 reels out a wire from the wire reel 34 via the wire guide 35, the stitching head 32 cuts the wire only a predetermined length, bends the cut wire into a U-shape and drives the U-shaped wire into the set of sheets. Simultaneously when the wire is driven, both ends of the U-shaped wire passed through the set of sheets are bent inward by the clincher 33, and the set of sheets is stitched. The stitched set of sheets is fed to a folding position, and folded into two along a stitching portion by the folding knife 36 and the folding roller 37. The folded set of sheets is fed to a cutting position, is trimmed by the cutter 38 at its front edge portion, and discharged into the discharge tray 40*a* or the discharge tray 40*b* via the delivery roller 39.

In the conventional sheet stitching apparatus, even when a trouble occurs in supply of the wire to the stitching head 32, the stitching head 32 keeps operating and a sheet stitching error is caused in some cases. In such a case, if the apparatus is not stopped immediately, detective products not-stitched are discharged one after another from the book-binding apparatus.

Hence, there is proposed a book-binding apparatus in which a detector for detection of a wire is arranged in midstream of a wire feed path from the wire reel to the stitching head, and when a wire is not detected, the sheet stitching apparatus is stopped (see Japanese Laid-Open Patent Publication No. 2005-74866).

According to this configuration, the detector can detect an error when a wire to be supplied to the stitching head runs out or a wire is cut in midstream of the wire feed path, but when the wire feed path clogs up or a wire becomes entangled or the stitching head does not operate normally, an error can not be detected, so that there is a problem that defective products are discharged one after another due to the abnormal operation of the sheet stitching apparatus.

To solve this problem, there is proposed another sheet stitching apparatus capable of detecting an error in wire feed operation instead of detecting a wire itself (see Japanese Laid-Open Patent Publication No. 2007-307892). FIG. 4 is an elevational view of a conventional sheet stitching apparatus. Referring to FIG. 4, the sheet stitching apparatus comprises a clincher 1 mounted on a frame (not shown), and a stitching head 2 arranged oppositely to the clincher 1 for reciprocal vertical movement between a standby position in which it is upwardly separated from the clincher 1 and a stitching position in which it abuts to the clincher 1. Although it is not illustrated in the drawing, the stitching head 2 is guided by a guide member mounted on the frame so as to be moved vertically, and is moved by a drive mechanism.

A wire insertion pipe 3 is mounted on an upper end of the stitching head 2 and extends upward from the stitching head 2. A base end 4*b* of the wire guide 4 consisting of a thin and long plate spring is fixed to an upper end of the wire insertion pipe 3.

A wire reel 5 is rotatably supported by a frame F. The wire reel 5 is located below a tip end 4*a* of the wire guide 4 and a side 5*a* thereof is arranged oppositely to one side 4*c* of the wire guide 4.

The wire guide 4 is bent in such a manner that the tip end 4*a* of the wire guide 4 is directed toward the wire reel 5 and the one side 4*c* is medially located, and at the same time, a wire W reeled out from the wire reel 5 is guided along the other side 4*d* of the wire guide 4, led through the wire insertion pipe 3, and supplied to the stitching head 2.

When the stitching head 2 is in the standby position, the stitching head 2 pulls in a wire W only a predetermined length and cuts the wire W, and while the stitching head 2 lowers from the standby position, the stitching head 2 bends the cut wire W into a U-shape, and when the stitching head 2 reaches the stitching position, the stitching head 2 drives the U-shape wire into the set of sheets S and the clincher 1 bends both ends of the U-shape wire.

One end of a thin and long support plate 6 is fixed to an upper end of the wire insertion pipe 3, and the support plate 6 is arranged oppositely to the one side 4*c* of the wire guide 4 at its one side 6*a*. The other end of the support plate 6 is provided with a proximity sensor 7 at its one side 6*a*.

When the stitching head 2 performs pull-in operation of wire, first, the wire W is pulled in the stitching head 2, while the wire reel 5 is not rotated, so that the tension applied to the wire W is increased, and thereby the wire guide 4 is bent. Consequently, the wire guide 4 approaches the proximity sensor 7 and the proximity sensor 7 detects the wire guide 4. Thereafter, the wire reel 5 is rotated by the restoring force of the wire guide 4 so as to reel the wire W out, so that the wire guide 4 returns to its original position. Consequently, the wire guide 4 gets away from the proximity sensor 7 and the proximity sensor 7 does not detect the wire guide 4.

The proximity sensor 7 detects the change of position of the wire guide 4 effected by the pull-in operation of wire W by the stitching head 2, whereby the timing of the change of position of the wire guide 4 is compared with the timing of stitching operation of the stitching head 2 and an error of wire feed operation is detected.

In the sheet stitching apparatus, however, when the remaining amount of wire of the wire reel 5 is large, the wire guide 4 is largely bent due to large tension applied to the wire W, the initial position of the wire guide 4 is close to the proximity sensor 7 (position (I) in FIG. 4), and as the remaining amount of wire of the wire reel 5 is reduced, since tension applied to the wire W is reduced, the degree of bending of the wire guide is reduced, and the initial position of the wire guide 4 gets away from the proximity sensor 7 (position (II) in FIG. 4). When the initial position of the wire guide 4 is largely changed, there occurs a problem that the change of position of the wire guide 4 due to the motion of the stitching head 2 can not be detected precisely.

SUMMARY OF THE INVENTION

It is, therefore an object of the present invention to precisely detect a change of position of a wire guide effected by a motion of a stitching head irrespective of the remaining amount of wire of a wire reel.

To achieve this object, according to the present invention, there is provided a sheet stitching apparatus comprising: a frame; a clincher mounted on the frame; a stitching head arranged oppositely to the clincher for reciprocal vertical movement between a standby position in which it is upwardly separated from the clincher and a stitching position in which it abuts the clincher; a guide member mounted on the frame and guiding the stitching head in such a manner that the stitching head can be moved vertically; a drive unit moving the stitching head; a wire insertion pipe mounted on an upper end of the stitching head and extending upward from the stitching head; a wire guide consisting of a thin and long plate spring, a base end of the wire guide being fixed to an upper end of the wire insertion pipe; and a wire reel rotatably supported by the frame below a tip end of the wire guide and arranged oppositely to one side of the wire guide at its side, wherein the wire guide is bent in such a manner that its tip end is directed toward the wire reel and the one side of the wire guide is medially located, and at the same time, a wire reeled out from the wire reel is guided along the other side of the wire guide, led through the wire insertion pipe and supplied to the stitching head, and when the stitching head is in the standby position, the stitching head pulls in the wire only a predetermined length and cuts the wire, and while the stitching head lowers from the standby position, the stitching head bends the cut wire into a U-shape, and when the stitching head reaches the stitching position, the stitching head drives the U-shaped wire into a set of sheets and at the same time, the clincher bends both ends of the U-shaped wire, and a detector arranged for movement according to a change in a degree of bending of the wire guide effected by a change of a remaining amount of the wire of the wire reel and detection of a change of position of the wire guide effected by the pull-in operation of wire by the stitching head.

According to a preferred embodiment of the invention, the detector comprises a swing arm pivotably connected to the upper end of the wire insertion pipe at one end thereof in such a manner that the swing arm can swing in a plane parallel to a plane where the wire guide is bent, a proximity sensor and a follower projection which are arranged at the other end of the swing arm, the proximity sensor and the follower projection being arranged oppositely to each other, the wire guide being located between the proximity sensor and the follower projection, the proximity sensor detecting the change of position of the wire guide effected by a pull-in operation of wire by the stitching head, and control means arranged between at least two of the swing arm, the wire insertion pipe and the turning shaft for controlling the swing movement of the swing arm so that the swing arm swings according to the change in the degree of bending of the wire guide effected by the change in the remaining amount of the wire of the wire reel, and the swing arm remains stationary during the pull-in operation of wire by the stitching head.

DESCRIPTION OF THE PREFERRED EMBODIMENTS

Figure 1:
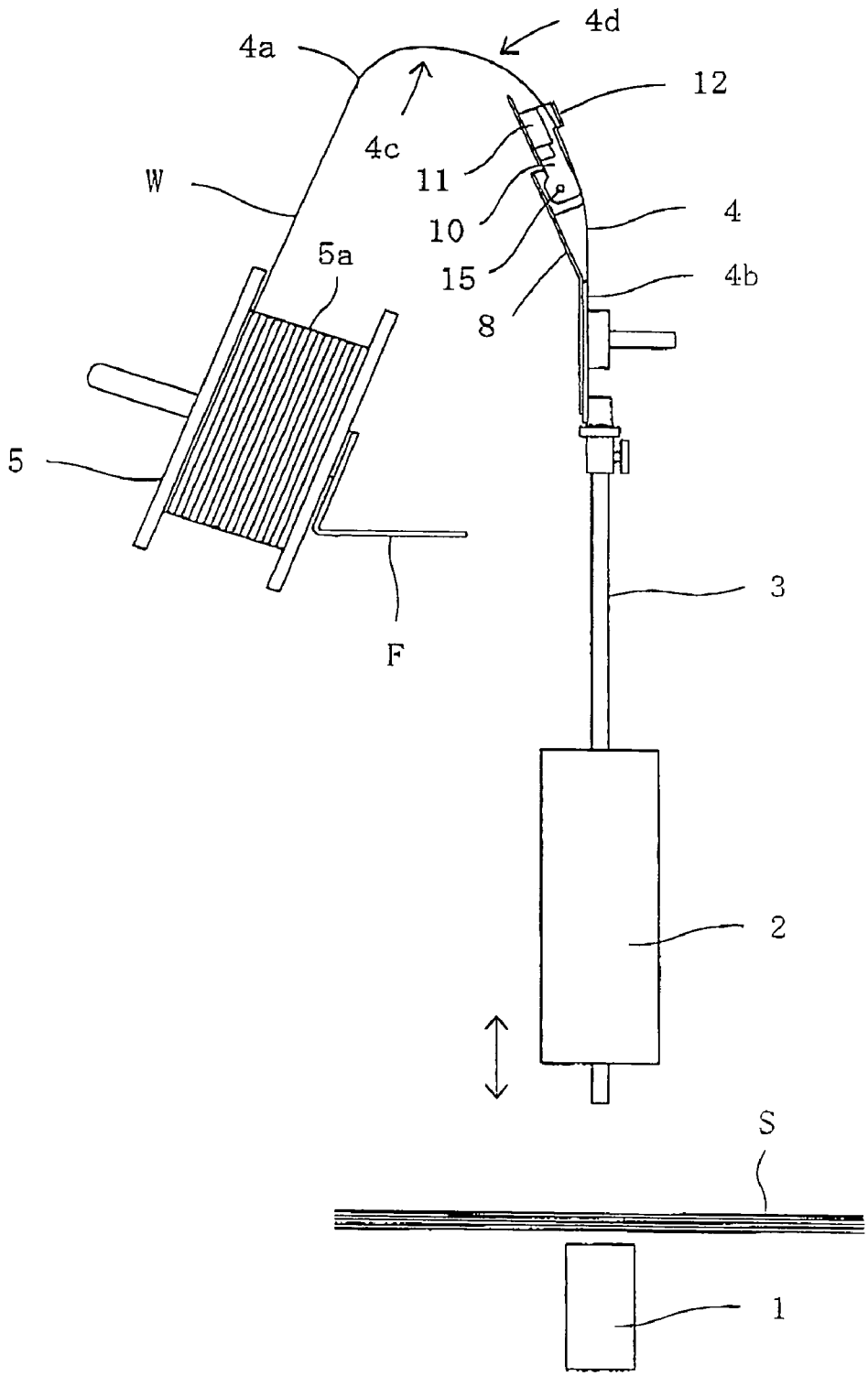
FIG. 1 is an elevational view of a sheet stitching apparatus according to one embodiment of the present invention.
Figure 2:
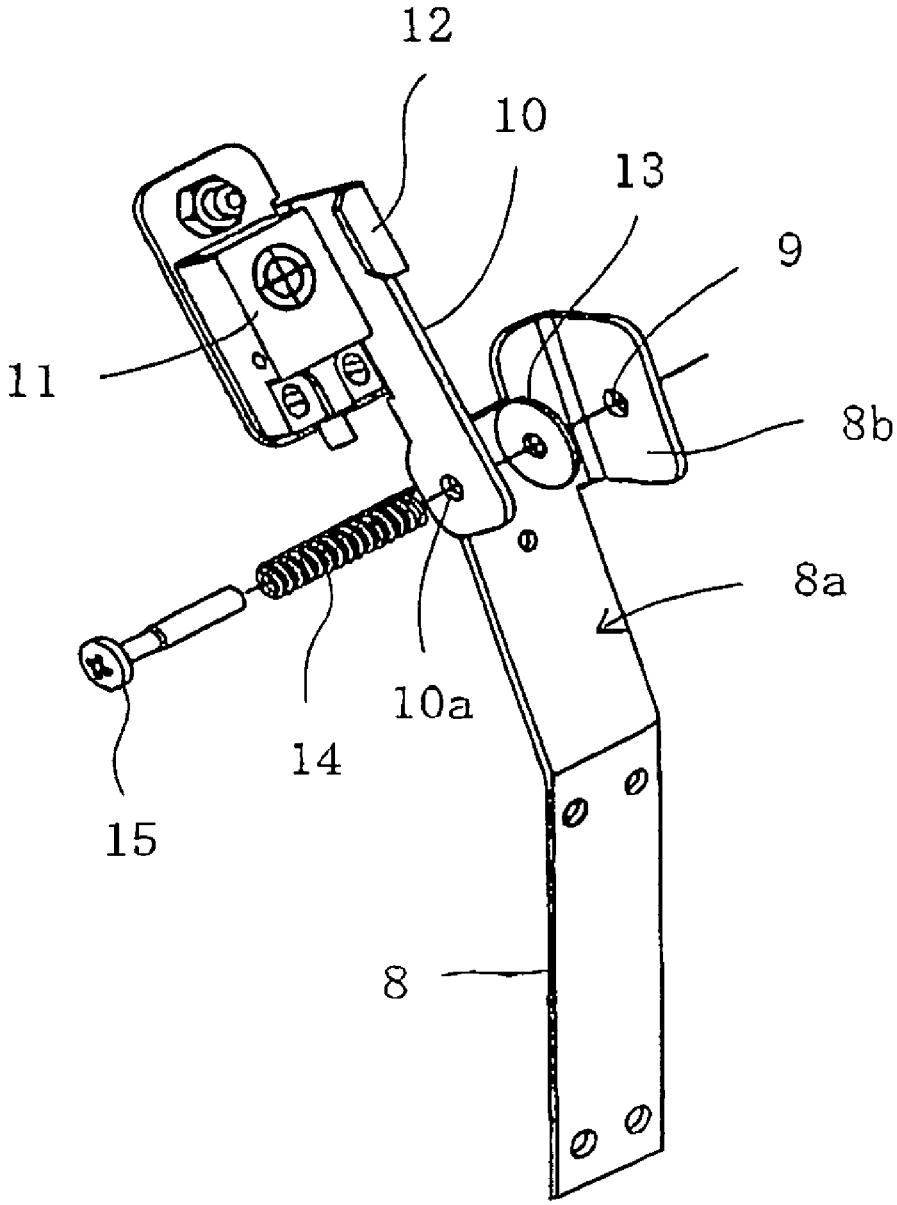
FIG. 2 is a perspective view showing a schematic configuration of a detector of the apparatus shown in FIG. 1.
Figure 3B:
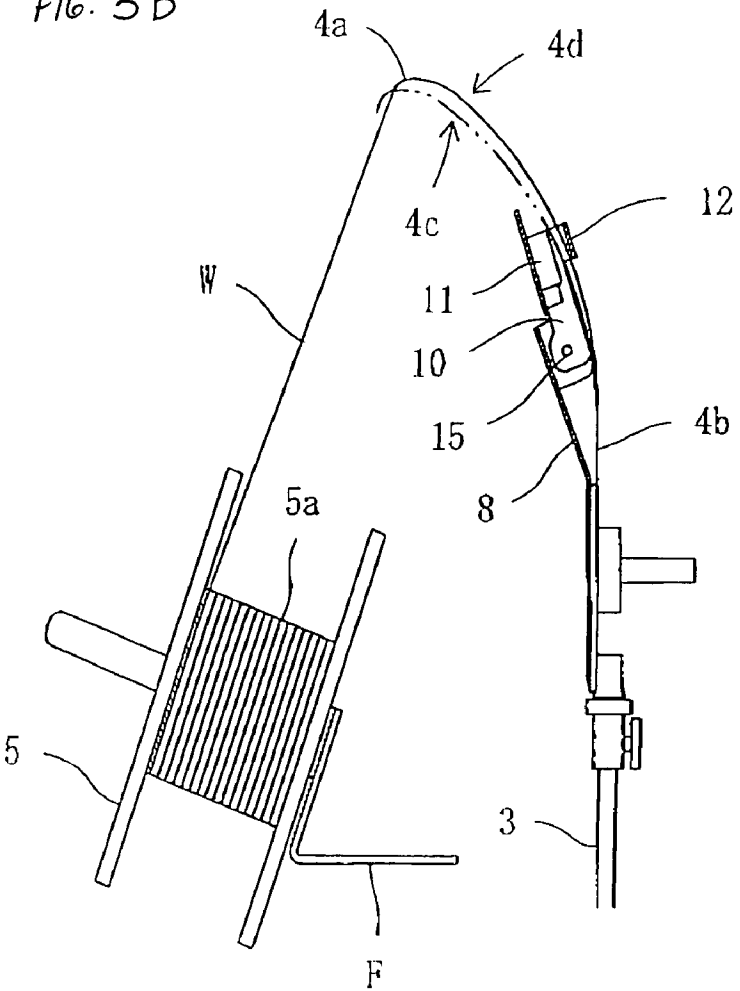
FIGS. 3A and 3B are elevational views explaining a motion of a swing arm of the apparatus shown in FIG. 1.
Figure 3A:
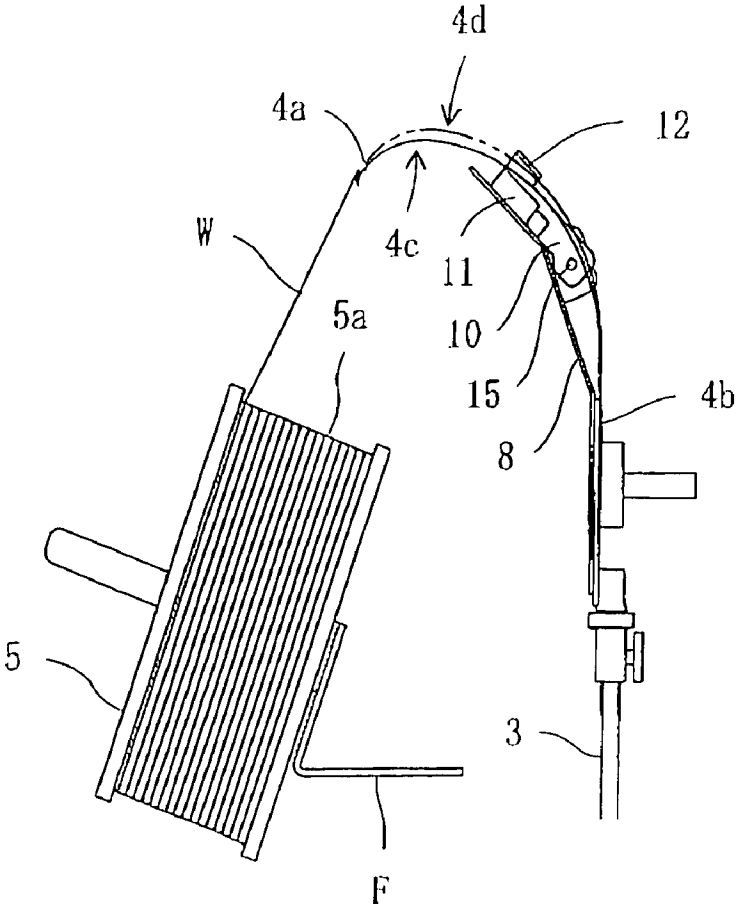
Figure 4:
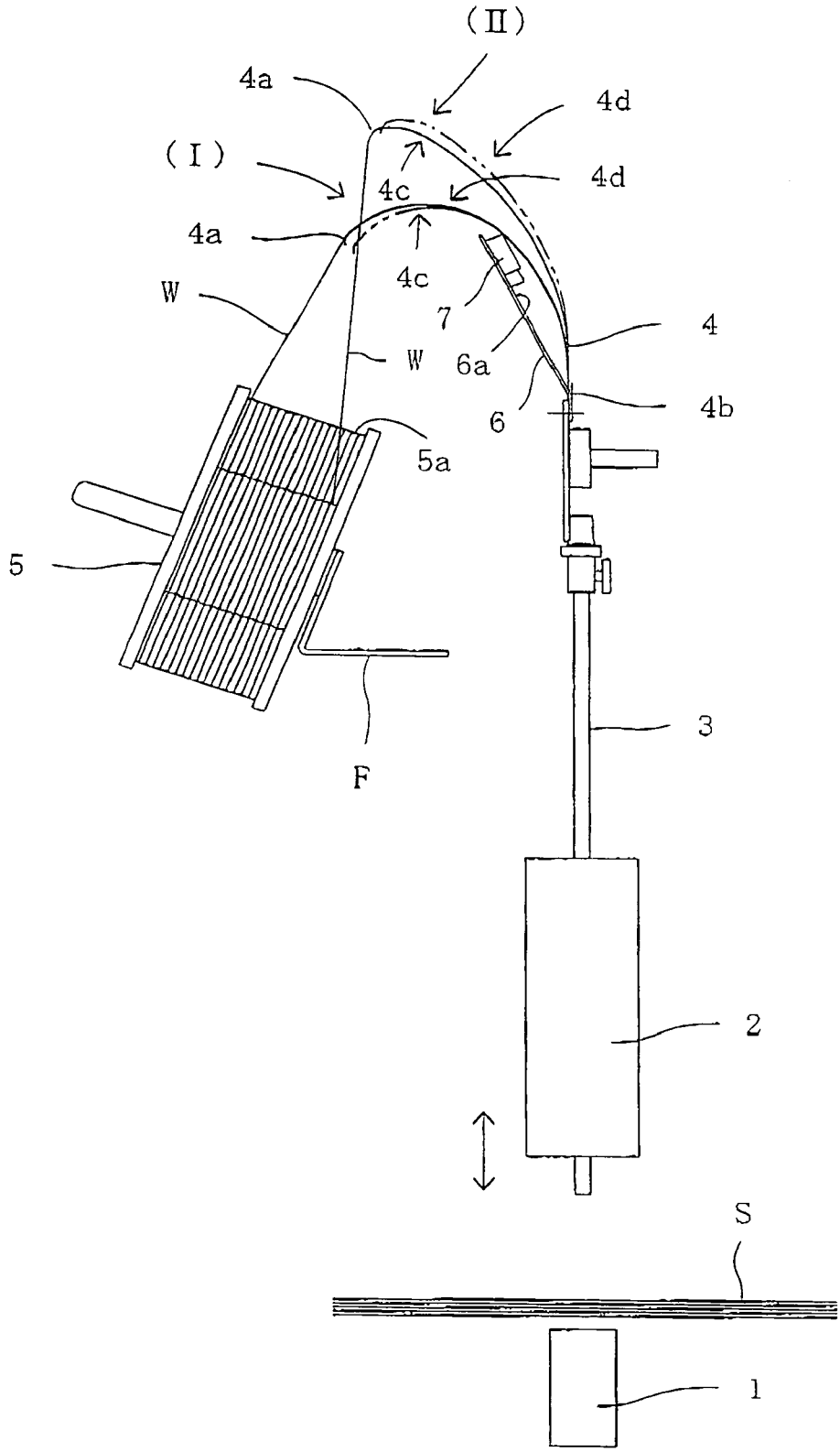
Fig. 4 Prior Art
FIG. 4 is an elevational view of a conventional sheet stitching apparatus.
Figure 5:
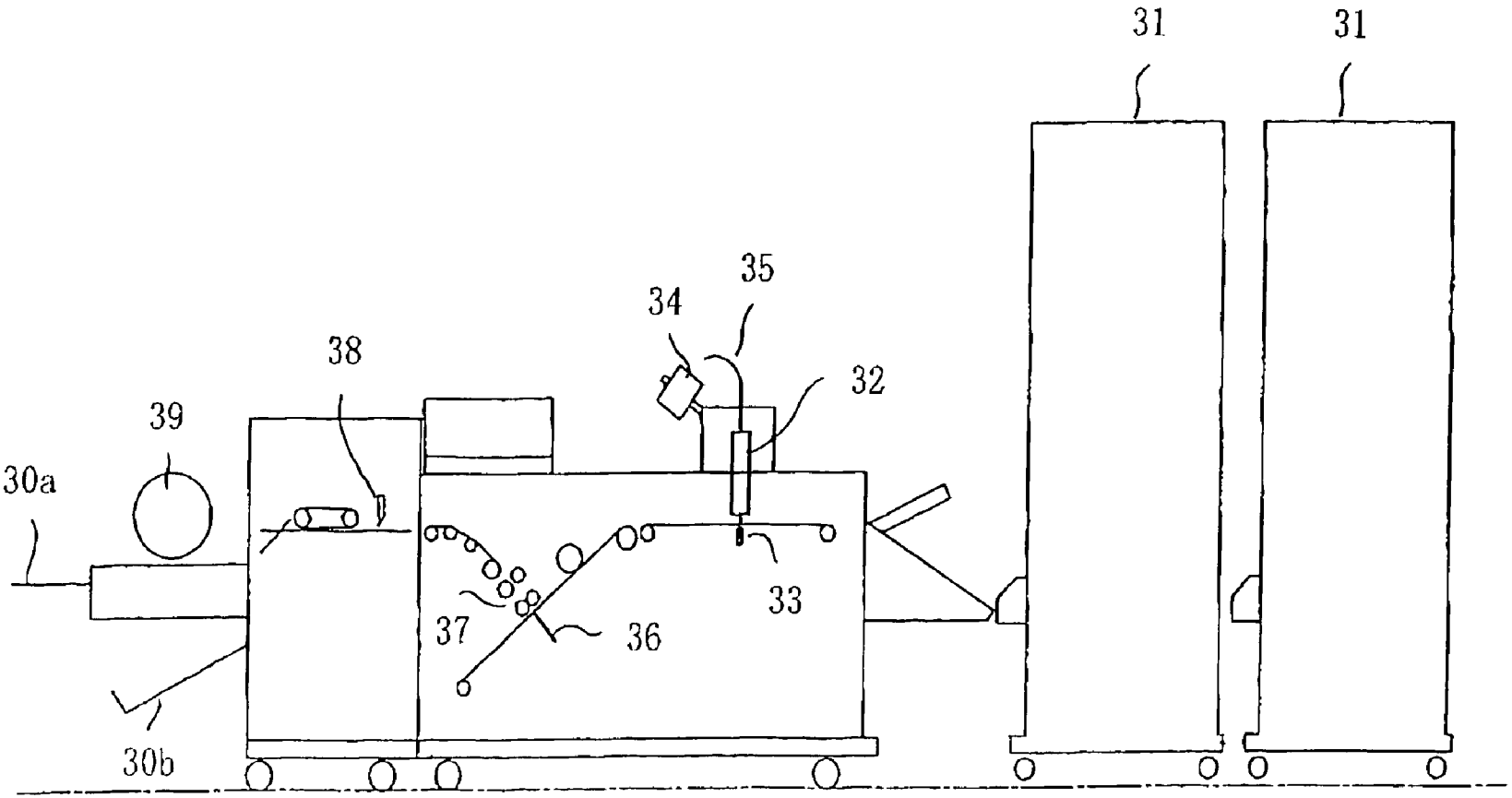
Fig. 5 Prior Art
FIG. 5 is a schematic diagram of a conventional saddle stitch book-binding apparatus.

A preferred embodiment of the present invention will be explained below. FIG. 1 is an elevational view of a sheet stitching apparatus according to one embodiment of the present invention. FIG. 2 is a perspective view showing a schematic configuration of a detector of the apparatus shown in FIG. 1. FIGS. 3A and 3B are elevational views explaining a motion of a swing arm of the detector. In FIGS. 1 to 3, the same structural elements as those shown in FIG. 4 are designated with the same reference numbers.

As shown in FIG. 1, the sheet stitching apparatus of the present invention comprises a clincher 1 mounted on a frame (not shown), and a stitching head 2 arranged oppositely to the clincher 1 for reciprocal vertical movement between a standby position (see FIG. 1) in which it is upwardly separated from the clincher 1 and a stitching position in which it abuts the clincher 1. Although it is not illustrated in the drawings, the stitching head 2 is guided by a guide member mounted on the frame so as to be moved vertically, and moved by a drive unit.

A wire insertion pipe 3 is mounted on an upper end of the stitching head 2, and extending upward from the stitching head 2. A base end 4*b* of the wire guide 4 consisting of a thin and long plate spring is fixed to an upper end of the wire insertion pipe 3.

A wire reel 5 is rotatably supported by a frame F. The wire reel 5 is located below a tip end 4*a* of the wire guide 4, and a side 5*a* of the wire reel 5 is arranged oppositely to one side 4*c* of the wire guide 4.

The wire guide 4 is bent in such a manner that its tip end 4*a* is directed toward the wire reel 5 and its one side 4*c* is medially located, and at the same time, a wire W reeled out from the wire reel 5 is guided along the other side 4*d* of the wire guide 4, led through the wire insertion pipe 3 and supplied to the stitching head 2.

In the standby position, the stitching head 2 pulls in the wire W only a predetermined length and cuts the wire W, and while the stitching head 2 is lowered from the standby position, the stitching head 2 bends the cut wire W into a U-shape. When the stitching head 2 reaches the stitching position, the stitching head 2 drives the U-shapes wire into a set of sheets S and at the same time, the clincher 1 bends both ends of the U-shaped wire inward, thereby stitching the set of sheets S.

According to the invention, a detector is arranged at an upper end of the wire insertion pipe 3 for movement according to a change in a degree of bending of the wire guide 4 effected by a change in a remaining amount of wire W of the wire reel 5, and detecting a change of the position of the wire guide 4 effected by the pull-in operation of the wire W by the stitching head 2.

In this embodiment, as shown in FIG. 2, the detector has an auxiliary plate 8 fixed to the upper end of the wire insertion pipe 3 and extending diagonally upward. The auxiliary plate 8 is arranged oppositely to the one side 4*c* of the wire guide 4 at one side 8*c* thereof. The tip end of the auxiliary plate 8 is provided with an arm mounting portion 8*b* extending perpendicular to the tip end at its one side edge. A swing arm 10 is pivotally connected to the arm mounting portion 8*b* at its one end. The connection of the swing arm 10 to the auxiliary plate 8 is performed by aligning a hole 10*a* of one end of the swing arm 10 with a hole 9 of the arm mounting portion 8*b* through a washer 13, leading a screw 15 in the holes 9 and 10*b*, and screwing the swing arm 10 to the arm mounting portion 8*b*. The swing arm 10 can swing around an axis of the screw 15 in a plane parallel to a plane where the wire guide 4 bends. In this case, a spring 14 is mounted on a screw portion between a head of the screw 15 and the swing arm 10 so that the swing motion of the swing arm 10 is controlled by adjusting a degree of fastening the screw 15.

The other end of the swing arm 10 is provided with a proximity sensor 11 at its one side edge and a follower projection 12 at its other side edge. The proximity sensor 11 and the follower projection 12 are arranged oppositely to each other. The wire guide 4 is located between the proximity sensor 11 and the follower projection 12, and the one side 4*c* of the wire guide 4 is arranged oppositely to the proximity sensor 11 and the other side 4*d* of the wire guide 4 is arranged oppositely to the follower projection 12.

By adjusting the degree of fastening the screw 15, the swing movement of the swing arm 10 is controlled in such a manner that the swing arm 10 swings according to the change in the degree of bending of the wire guide 4 effected by the change in the remaining amount of the wire W of the wire reel 5, and the swing arm 10 remains stationary during the pull-in operation of wire by the stitching head. The proximity sensor 11 detects the wire guide 4 whenever the stitching head 2 pulls in the wire W.

That is, as shown in FIG. 3(A), when the remaining amount of the wire W of the wire reel 5 is large, the wire guide 4 is largely bent due to large tension applied to the wire W, correspondingly, the swing arm 10 swings in the counterclockwise direction around the axis of the screw 15, and the swing arm 10 assumes the initial position largely inclined toward the wire reel 5. In this position, when the stitching head 2 performs pull-in operation of the wire W, first, the wire W is pulled in the stitching head 2, while the wire reel 5 is not rotated, so that the tension applied to the wire W is increased, and thereby the wire guide 4 is bent. Consequently, the wire guide 4 approaches the proximity sensor 7 and the proximity sensor 7 detects the wire guide 4. Thereafter, the wire reel 5 is rotated by the restoring force of the wire guide 4 so as to reel the wire W out, so that the wire guide 4 returns to its original position. Consequently, the wire guide 4 gets away from the proximity sensor 7 and the proximity sensor 7 does not detect the wire guide 4.

As show in FIG. 3(B), when the remaining amount of the wire W of the wire reel 5 is reduced, the tension applied to the wire W is gradually reduced, the wire guide 4 gradually rises, the swing arm 10 is pushed up by the wire guide 4 and swings around the axis of the screw 15 in the clockwise direction and the initial position gradually rises. In this position, when the stitching head 2 performs pull-in operation of the wire W, first, the wire W is pulled in the stitching head 2, while the wire reel 5 is not rotated, so that the tension applied to the wire W is increased, and thereby the wire guide 4 is bent. Consequently, the wire guide 4 approaches the proximity sensor 7 and the proximity sensor 7 detects the wire guide 4. Thereafter, the wire reel 5 is rotated by the restoring force of the wire guide 4 so as to reel the wire W out, so that the wire guide 4 returns to its original position. Consequently, the wire guide 4 gets away from the proximity sensor 7 and the proximity sensor 7 does not detect the wire guide 4.

According to the present invention, it is possible to precisely detect the change of position of the wire guide 4 effected by the pull-in operation of the wire W by the stitching head 2 irrespective of the remaining amount of the wire W of the wire reel 5.

It is possible to monitor a state of operation of the sheet stitching apparatus based on a detection signal of the change of position of the wire guide 4 and an operation signal of the stitching head 2. That is, when the stitching head 2 is in the standby position and an operation signal is sent to the stitching head 2, if the wire guide 4 is detected and then the wire guide 4 is not detected, it is determined that the sheet stitching apparatus is normally operating. At this time, if the wire guide 4 is not detected, it is determined that the wire W of the wire reel 5 runs out, and a wire feed error signal is generated. If the wire guide 4 is detected for more than a predetermined time after the operation signal is sent to the stitching head 2, it is determined that the wire feed path is clogs up or a wire becomes entangled, a wire feed error signal is generated, and the operation of the sheet stitching apparatus is stopped.

What is claimed is:

1. A sheet stitching apparatus comprising:

a frame;

a clincher mounted on the frame;

a stitching head arranged oppositely to the clincher for reciprocal vertical movement between a standby position in which it is upwardly separated from the clincher and a stitching position in which it abuts the clincher;

a guide member mounted on the frame and guiding the stitching head in such a manner that the stitching head can be moved vertically;

a drive unit moving the stitching head;

a wire insertion pipe mounted on an upper end of the stitching head and extending upward from the stitching head;

a wire guide consisting of a thin and long plate spring, a base end of the wire guide being fixed to an upper end of the wire insertion pipe; and a wire reel rotatably supported by the frame below a tip end of the wire guide and arranged oppositely to one side of the wire guide at its side, wherein the wire guide is bent in such a manner that its tip end is directed toward the wire reel and the one side of the wire guide is medially located, and at the same time, a wire reeled out from the wire reel is guided along the other side of the wire guide, led through the wire insertion pipe and supplied to the stitching head, and when the stitching head is in the standby position, the stitching head pulls in the wire only a predetermined length and cuts the wire, and while the stitching head lowers from the standby position, the stitching head bends the cut wire into a U-shape, and when the stitching head reaches the stitching position, the stitching head drives the U-shaped wire into a set of sheets and at the same time, the clincher bends both ends of the U-shaped wire, and a detector arranged for movement according to a change in a degree of bending of the wire guide effected by a change of a remaining amount of the wire of the wire reel and detection of a change of position of the wire guide effected by the pull-in operation of wire by the stitching head.

2. The sheet stitching apparatus according to claim 1, wherein the detector comprises a swing arm pivotably connected to the upper end of the wire insertion pipe at one end thereof in such a manner that the swing arm can swing in a plane parallel to a plane where the wire guide is bent, a proximity sensor and a follower projection which are arranged at the other end of the swing arm, the proximity sensor and the follower projection being arranged oppositely to each other, the wire guide being located between the proximity sensor and the follower projection, the proximity sensor detecting the change of position of the wire guide effected by a pull-in operation of wire by the stitching head, and control means arranged between at least two of the swing arm, the wire insertion pipe and the turning shaft for controlling the swing movement of the swing arm so that the swing arm swings according to the change in the degree of bending of the wire guide effected by the change in the remaining amount of the wire of the wire reel, and the swing arm remains stationary during the pull-in operation of wire by the stitching head.

* * * * *